US008054230B2

(12) United States Patent
Su et al.

(10) Patent No.: US 8,054,230 B2
(45) Date of Patent: Nov. 8, 2011

(54) MULTI-BAND ANTENNA

(75) Inventors: Wen-Fong Su, Tu-cheng (TW); Shu-Yean Wang, Tu-cheng (TW); Hsien-Sheng Tseng, Tu-cheng (TW); Shang-Jen Chen, Tu-cheng (TW); Chun-Ming Chiu, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 622 days.

(21) Appl. No.: 12/221,290

(22) Filed: Jul. 31, 2008

(65) Prior Publication Data

US 2009/0033560 A1 Feb. 5, 2009

(30) Foreign Application Priority Data

Jul. 31, 2007 (TW) ..... 96212499 A

(51) Int. Cl.
*H01Q 1/24* (2006.01)

(52) U.S. Cl. ..... 343/702; 343/700 MS; 343/846

(58) Field of Classification Search ..... 343/700, 343/702, 829, 846
See application file for complete search history.

(56) References Cited

U.S. PATENT DOCUMENTS

| | | | | |
|---|---|---|---|---|
| 6,861,986 | B2 | 3/2005 | Fang | |
| 7,839,342 | B2 * | 11/2010 | Su et al. | 343/702 |
| 2009/0073050 | A1 * | 3/2009 | Cheng | 343/700 MS |

FOREIGN PATENT DOCUMENTS

| | | | |
|---|---|---|---|
| CN | 1747235 | A | 3/2006 |
| CN | 2924808 | Y | 7/2007 |

* cited by examiner

*Primary Examiner* — Tho G Phan
(74) *Attorney, Agent, or Firm* — Wei Te Chung; Andrew C. Cheng; Ming Chieh Chang

(57) ABSTRACT

A multi-band antenna includes a grounding element having a first side, a radiating element separated form the first side of the grounding element, and a connecting element. The connecting element connects the grounding element to the radiating element and includes a first end slantwise extending from the grounding to form a first angle except a right angle between the connecting element and the grounding element.

19 Claims, 3 Drawing Sheets

MULTI-BAND ANTENNA

BACKGROUND OF THE INVENTION

1. Field of the Invention

The present invention relates generally to a multi-band antenna, and more particularly to a multi-band antenna suitable for built into an electronic device, such as a notebook.

2. Description of the Prior Art

In recent years, antennas working for Wireless Local Area Net (WLAN) become basic components in wireless communication devices. The inner antennas are of the smaller the better. U.S. Pat. Nos. 6,861,986, and 6,812,892 disclose a type of planar invert-F antennas, which comprises a radiating element, a grounding element and a connecting element connecting the radiating element to the grounding element. And the connecting element comprises a first side, a second side and a third side connecting the first side to the second side. The three-section structure of the connecting element is used to match the antenna impedance. However, three-section structure of the connection element is relative complex. Thus, a simpler structure of the connection element is needed to be designed and used on antennas.

Hence, in this art, a multi-band antenna to overcome the above-mentioned disadvantages of the prior art should be provided.

BRIEF SUMMARY OF THE INVENTION

A primary object, therefore, of the present invention is to provide a multi-band antenna with simple structure.

In order to implement the above object, the multi-band antenna comprises a grounding element having a first side, a radiating element separated form the first side of the grounding element, and a connecting element. The connecting element connects the grounding element to the radiating element and comprises a first end slantwise extending from the grounding to form a first angle except a right angle between the connecting element and the grounding element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
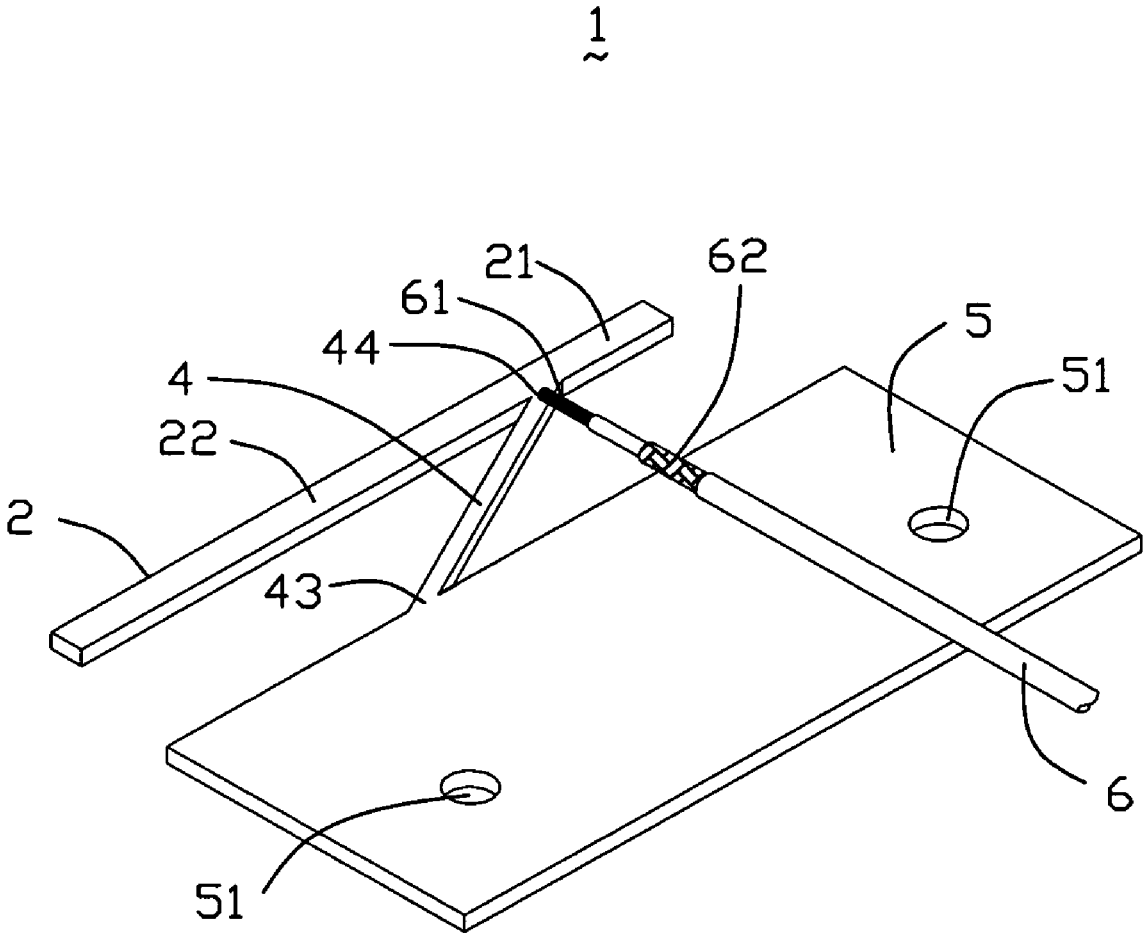
FIG. 1 is a perspective view illustrating a first embodiment of a multi-band antenna in according with the present invention.

Reference to FIG. 1, a multi-band antenna in according with a first embodiment of the present invention is shown. In the first embodiment, the multi-band antenna 1 is assembled in an electric device such as a notebook or a mobile phone to receive/send signals. The multi-band antenna 1 comprises a radiating element 2, a connecting element 4, a grounding element 5 and a feeding line 6.

The grounding element 5 is of rectangular shape and comprises a first side and a pair of holes 51 used as setting holes.

The connecting element 4 slantwise extends from the first side of the grounding element 5 and comprises a first end 43 connected to the grounding element 5 and a second end 44 connected to the radiating element 2. An first angle except right-angle is formed between the connecting element 4 and the grounding element 5. And an second angle is formed between the connecting element 4 and the radiating element 2. The first angle is same as the second angle.

The radiating element 2 extends longwise to define a first radiating section 21 and a second radiating section 22. The first radiating section 21 and the second radiating section 22 respectively extends from the connecting element along different directions. The first radiating section 21 is connected to the second radiating section 22 to form a line-shape structure. The radiating element 2 is parallel to the first side of the grounding element.

The feeding line 6 comprises an inner conductor 61 connected to the joint of the radiating element 2 and the connecting element 4 to form a feeding point and an outer conductor 62 connected a grounding point on the grounding element 5. The connecting element 4, the feeding line 6 and the first side 50 of the grounding element 5 compose a triangle shape.

Figure 3:
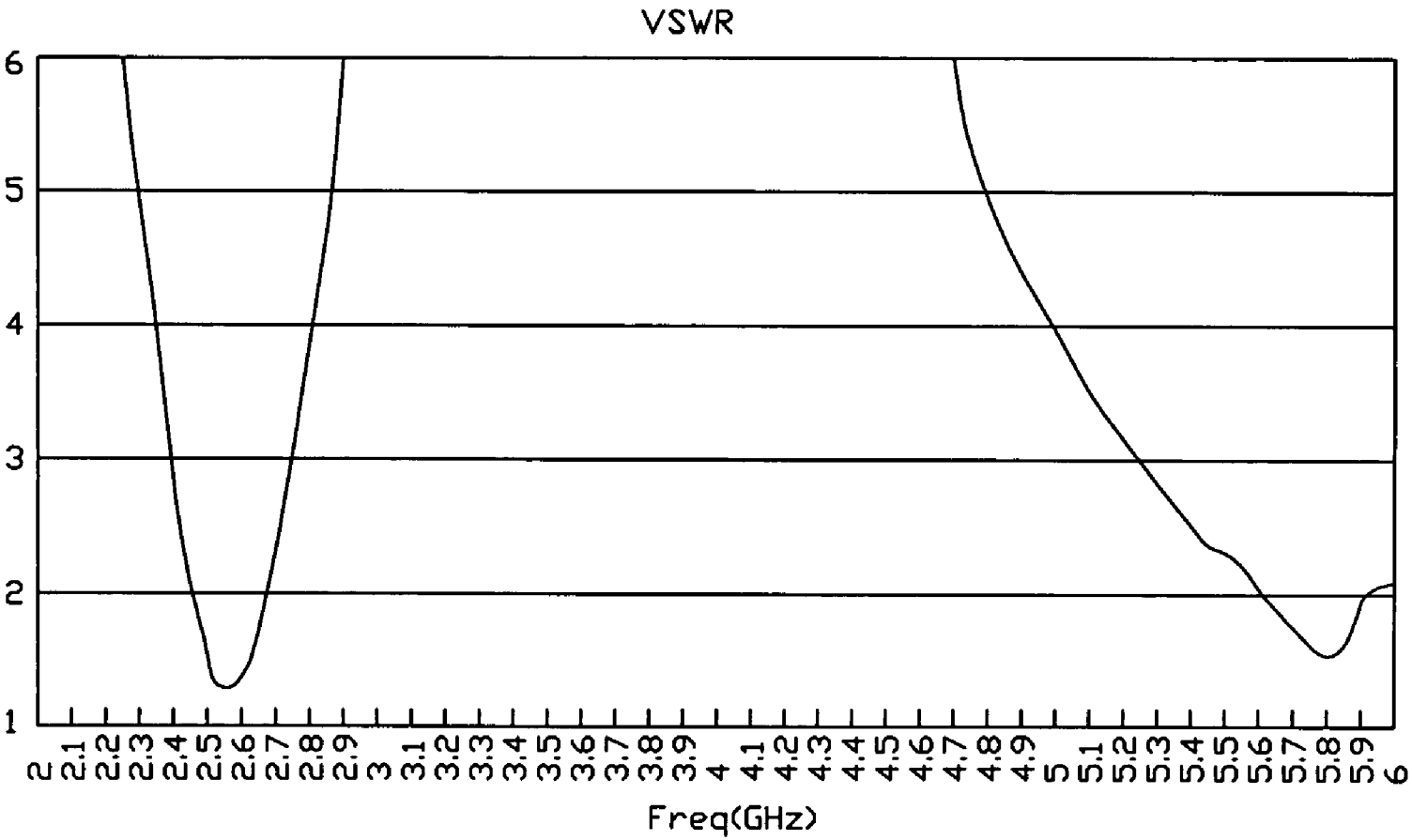
FIG. 3 is a test chart recording for the multi-band antenna of FIG. 1, showing Voltage Standing Wave Ratio (VSWR) as a function of WLAN frequency.

In the first embodiment, the multi-band antenna 1 is made from a metal patch. And the radiating element 2, the connecting element 4 and the grounding element 5 are on the same plane. Reference to FIG. 3, a test chart recording for the Voltage Standing Wave Ratio (VSWR) in according with the multi-band antenna 1 is shown. It shows that the multi-band antenna 1 works at a first frequency band on 2.3-2.7 GHz and a second frequency band on 5.2-6 GHz. The first radiating section 21 resonates the first frequency band and the second radiating section 22 resonates the second frequency band.

In other embodiments, the multi-band antenna could be formed by etching a Printed Circuit Board. The radiating element 2 and the connecting element 4 could be on a plane different from the plane which the grounding element 5 is located on. The shape of the grounding element 5 could be changed in need. The inner conductor 61 of the feeding line 6 is able to be connected to another point on the connecting element 4 different form the feeding point.

Figure 2:
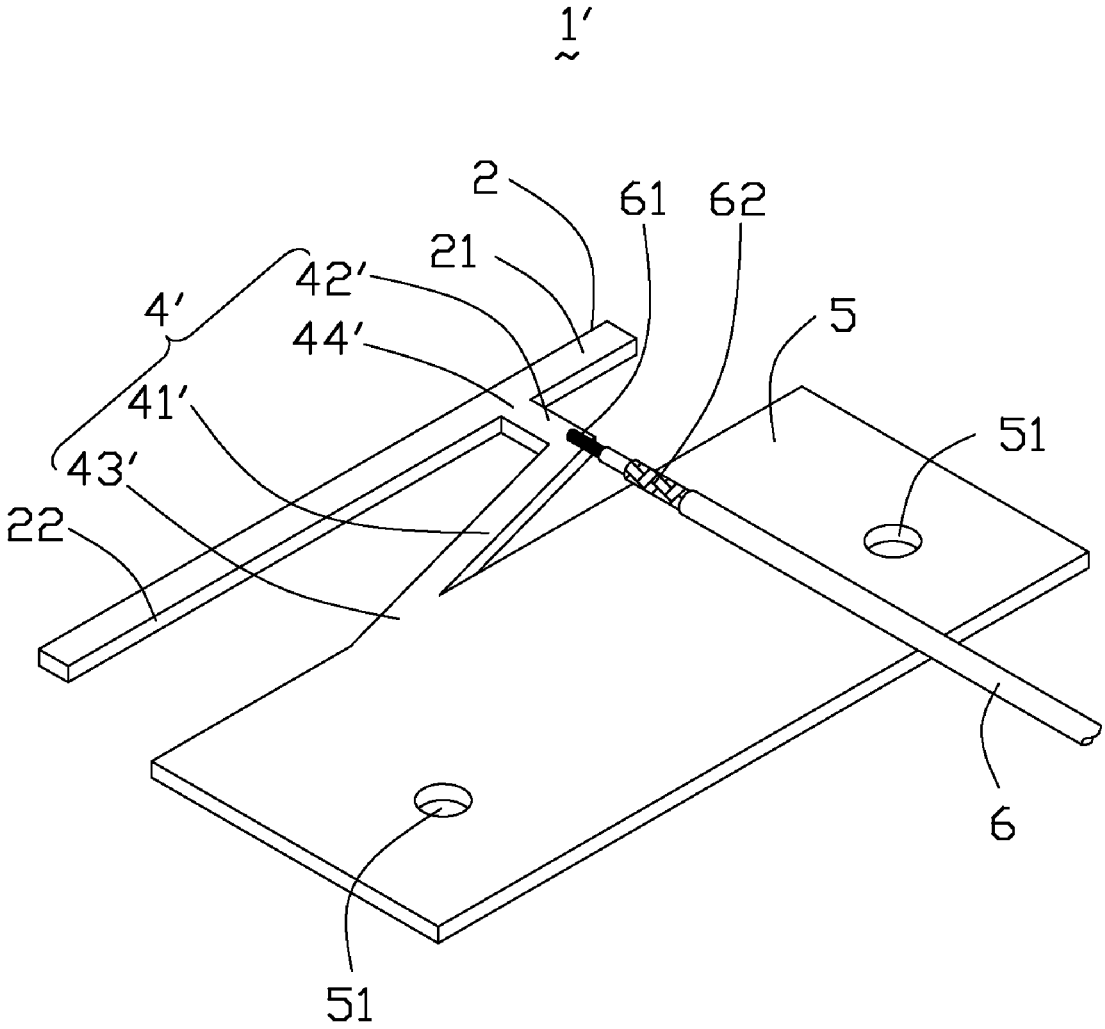
FIG. 2 is a perspective view illustrating a second embodiment of a multi-band antenna in according with the present invention.

Reference to FIG. 2, a multi-band antenna 1' in according with a second embodiment of the present invention is shown. The multi-band antenna 1' also comprises a radiating element 2, a connecting element 4', a grounding element 5 and a feeding line 6. The radiating element 2 and grounding element 5 are same as that of the multi-band antenna 1. Differently, the connecting element 4' comprises a first arm 41' slantwise extending form the grounding element 5 and connected to the grounding element 5 on the first end 43', and a second arm 42' extending form the first arm 41' and connected to the radiating element 2 on the second end 44'. An third angle except right-angle is formed between the grounding element 5 and the first arm 41'. The second arm 42' is perpendicular to the radiating element 2'. The inner conductor 61 of the feeding line 6 is connected to the joint of the first arm 41' and the second arm 42. The outer conductor 62 is connected to the grounding element 5. The feeding line 6 extends along a direction approximately perpendicular to the radiating element 2. Understandably, other embodiments may switch positions of the first arm 41' and the second arm'42 if necessary.

What is claimed is:

1. A multi-band antenna, comprising:

a grounding element, comprising a first side;

a radiating element, separated form the first side of the grounding element;

a connecting element, connecting the grounding element to the radiating element and comprising a first end slantwise extending from the grounding element to form a first angle except right-angle between the connecting element and the grounding element.

2. The multi-band antenna as claimed in claim 1, also comprises a feeding line.

3. The multi-band antenna as claimed in claim 2, wherein said feeding line comprises an inner conductor connected to the connecting element and an outer conductor connected to the grounding element.

4. The multi-band antenna as claimed in claim 3, wherein said connecting element comprises a second end connected to the radiating element to form a second angle same as the first angle.

5. The multi-band antenna as claimed in claim 4, wherein said inner conductor of the feeding line is connected to the joint of the connecting element and the radiating element.

6. The multi-band antenna as claimed in claim 5, wherein said feeding line, the connecting element and the first side of the grounding element compose a triangle shape.

7. The multi-band antenna as claimed in claim 3, wherein said connecting element comprises a first arm with the first end and a second arm having a second end connected to the radiating element.

8. The multi-band antenna as claimed in claim 7, wherein said second arm is perpendicular to the radiating element.

9. The multi-band antenna as claimed in claim 7, wherein said inner conductor of the feeding line is connected to the joint of the first arm and the second arm of the connecting element.

10. The multi-band antenna as claimed in claim 7, wherein said feeding line, the first arm and the first side of the grounding composes a triangle shape.

11. The multi-band antenna as claimed in claim 1, wherein said radiating element is parallel to the first side of the grounding element.

12. A multi-band antenna, comprising:

a grounding element;

a radiating element, separated from the grounding element and comprising a first radiating section and a second section;

a connecting element, comprising a first end connected to the grounding element and a second end connected to the radiating element; and a feeding line, comprising an inner conductor and an outer conductor;

said connecting element comprising at most two arms.

13. The multi-band antenna as claimed in claim 12, wherein said connecting element comprises a first arm and a second arm extending from the first arm, said first arm slantwise extends from the grounding element and is connected to the grounding element on said first end, said first arm is connected to the radiating element on said second end.

14. The multi-band antenna as claimed in claim 13, wherein said first radiating section is connected to the second radiating section to form a line-shape structure.

15. The multi-band antenna as claimed in claim 14, wherein said second arm of the connecting element is perpendicular to the radiating element.

16. The multi-band antenna as claimed in claim 15, wherein said inner conductor of said feeding line is connected to the joint of the first arm and the second arm.

17. A multi-band antenna comprising:

a grounding element;

a radiating element essentially defining a longitudinal direction thereof and distanced, in a transverse direction perpendicular to said longitudinal direction, from the grounding element with a space therebetween;

a connecting element located in said space and connected between the radiating element and the grounding element, said connecting element defining a strip like first arm which extending roughly in an oblique direction relative to the longitudinal direction; and a feeder cable including an outer conductor connected to the grounding element and an inner conductor connected to a region around a joint between the radiating element and the connecting element so that a sufficient room is formed between the first arm and the grounding element for adjusting required frequencies; wherein said radiating element is divided into two segments by two sides of said joint for compliance with high and low frequencies, respectively.

18. The multi-band antenna as claimed in claim 17, wherein the said connecting element further includes a second arm connecting to one of said radiating element and said grounding element.

19. The multi-band antenna as claimed in claim 18, wherein said second arm is connected to the radiating element, and the inner conductor is mainly connected to said second arm.

* * * * *